United States Patent [19]

Ando et al.

[11] Patent Number: 4,817,542

[45] Date of Patent: Apr. 4, 1989

[54] CLOTH TERMINUS DETECTING APPARATUS FOR SEWING MACHINE HAVING MEANS TO AUTOMATICALLY SELECT A SENSOR IN RELATION TO A FEED SETTING

[75] Inventors: Tsukasa Ando, Nishikasugai; Seiichiro Hagino, Chiryu, both of Japan

[73] Assignee: Aisin Seiki Kabushiki Kaisha, Kariya, Japan

[21] Appl. No.: 187,849

[22] Filed: Apr. 29, 1988

[30] Foreign Application Priority Data

Apr. 30, 1987 [JP] Japan ..... 62-107538

[51] Int. Cl.[4] ..... D05B 19/00

[52] U.S. Cl. ..... 112/121.11; 112/272; 112/315

[58] Field of Search ..... 112/121.11, 272, 275, 112/315, 314, 121.12, 277, 262.1, 2

[56] References Cited

U.S. PATENT DOCUMENTS

| | | | |
|---|---|---|---|
| 4,495,877 | 1/1985 | Willenbacher | 112/272 X |
| 4,565,140 | 1/1986 | Martell et al. | 112/121.11 |
| 4,682,554 | 7/1987 | Goto et al. | 112/315 X |

*Primary Examiner*—Peter Nerbun

*Attorney, Agent, or Firm*—Oblon, Fisher, Spivak, McClelland & Maier

[57] ABSTRACT

An apparatus for detecting the terminus of cloth being sewn by a sewing machine. A plurality of sensors are disposed on a path along which the cloth is fed and at positions upstream of the needle, and they each consist of a light emitting portion and a light receiving portion paired and disposed in opposition. A detector electrically detects a set cloth feed amount, and a selection circuit operates to electrically select one of the sensors which is positioned at the optimum position with respect to the set cloth feed amount.

2 Claims, 4 Drawing Sheets

CLOTH TERMINUS DETECTING APPARATUS FOR SEWING MACHINE HAVING MEANS TO AUTOMATICALLY SELECT A SENSOR IN RELATION TO A FEED SETTING

BACKGROUND OF THE INVENTION

Field of the Invention

The present invention relates to an apparatus for detecting the terminal end (hereinafter referred to as the "terminus") of cloth being sewn by a sewing machine and, more particularly, to an apparatus of this type which may be used in an industrial sewing machine or the like as an apparatus for detecting the cloth terminus or the cloth overlap.

An apparatus of this type is known from, for instance, the prior art disclosed in Japanese Patent Publication No. 2393/1986.

The prior art has an arrangement which consists of a combination of two cloth terminus sensors, sensors disposed in the needle tip detecting section and the pulley rotational angle detecting section, and an electronic arithmetic control section. In this arrangement, as shown in FIG. 7, two cloth terminus detecting sensors 21 and 22 are disposed upstream of the needle 20 in the direction in which the cloth is fed, and the cloth feed amount required for finally stopping a needle 20 correctly at a predetermined stop position is calculated by detecting the number of movements of the needle operation required to sew the cloth through a distance l1 between the two sensors.

The first cloth terminus detecting means 21 detects whether there is the cloth at a first cloth detecting position on the upstream side of the needle 20, while the second cloth terminus detecting means 22 detects whether there is the cloth between the first cloth detecting position and the needle 20. If it is assumed that the distance between the first and second detecting means 21 and 22 is represented by l1 while that between the second detecting means 22 and the needle 20 is represented by l2, it would be noted that the prior art encounters the following structural disadvantages:

(1) The distance which has to be sewn before the needle stops inevitably includes the distance l1 in addition to the distance l2. This means that the necessary sewing distance cannot be shorter than l1+l2.

(2) In actual operation, if the machine is to be stopped after a signal has been received from the first sensor, a certain time is required before it stops because of some mechanical reasons (such as those relating to the stopping performance of the motor). In addition, the distance l2 has to be set while taking into consideration the case where the amount by which the cloth is fed by the machine per movement of the needle operation is set at the maximum value (This amount of cloth feed, which can be set by the operator, will hereafter be called the "feed amount"). Accordingly, these factors inevitably increase the necessary sewing distance l1+l2. In particular, when the feed amount is set at a small value, the stoppage error will be relatively large.

An additional description will be given concerning the distance 2. This distance must satisfy the following relationship if, for instance, four movements of the needle operation are necessary before the machine stops in stopping the motor in response to a signal output from the second sensor 22 and, simultaneously, the maximum value of the feed amount is 4 mm:

Because 4 mm×4=16 mm, $$l2 > 16 \text{ mm}$$

(the distance corresponding to this 16 mm will hereafter be referred to as a "stop enable distance").

SUMMARY OF THE INVENTION

Accordingly, an object of the present invention is to provide a cloth terminus detecting apparatus for a sewing machine which is capable of eliminating the above-described disadvantages of the prior art.

To this end, according to the present invention, a plurality of sensors (n1 and n2) each consisting of a light emitting portion and a light receiving portion are disposed on a path along which cloth is fed and at positions upstream of a needle. Each of the sensors is connected to an analog switch, and one of the sensors which is closest to the needle and which ensures a needle stop enable distance depending on a set cloth feed amount is electrically selected (see FIG. 1).

The cloth feed amount is detected by a potentiometer provided on a feed amount regulating mechanism, as will be described later in the embodiment.

The cloth feed amount, which has been freely set, is electrically detected by the potentiometer which rotates in synchronism with a feed amount regulating cam. The output of the potentiometer is subjected to A/D conversion and is then supplied to a microcomputer which calculates the feed amount from the result of the detection.

As will be described later in the embodiment, the microcomputer also performs calculations to determine which one of the plurality of sensors is to be used, and the optimal sensor is selected through the operation of the analog switch.

BRIEF DESCRIPTION OF THE DRAWINGS

FIGS. 3 to 6 are views used to explain a sewing operation performed with the apparatus of the present invention, wherein FIG. 5 is a block diagram and FIG. 6 is a flowchart.

DESCRIPTION OF THE PREFERRED EMBODIMENT

The preferred embodiment of the present invention will be described hereunder with reference to FIGS. 1 to 6.

Figure 1:
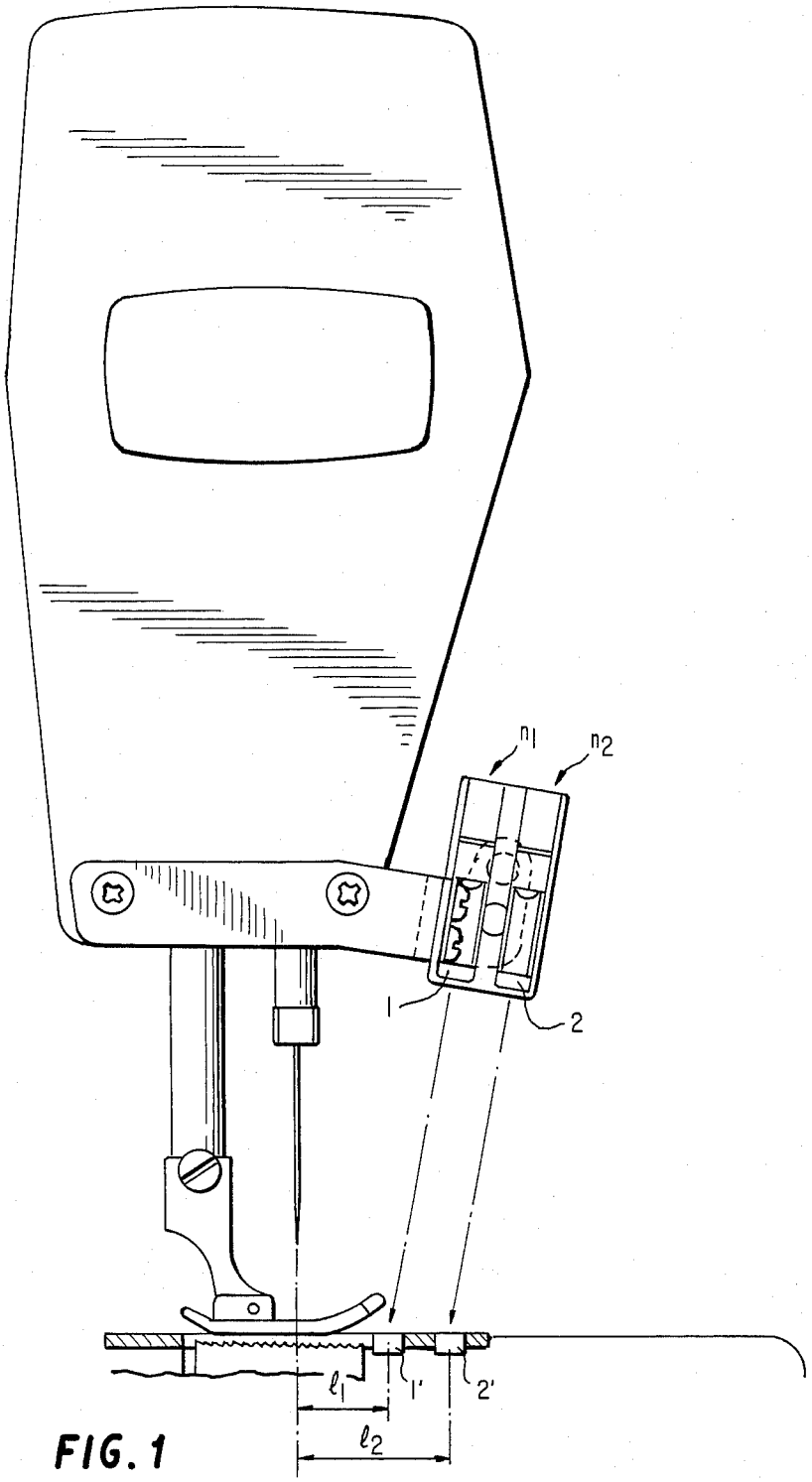
FIG. 1 is a view used to explain the arrangement of sensors of the apparatus in accordance with the present invention.

FIG. 1 shows two sensors n1 and n2 for detecting the terminus of, for instance, a piece of cloth being sewn. The sensors n1 and n2 each consist of paired portions, i.e., a light emitting portion 1 and a light receiving portion 1', or a light emitting portion 2 and a light receiving portion 2'.

The sensors n1 and n2 are disposed on the cloth feeding side of a needle of the sewing machine associated. More specifically, the sensor n1, which is closer of the two to the needle, is disposed at a distance L1 from the needle which is sufficient to ensure, after the output of a cloth terminus detection signal from the sensor n1, at least a stop enable distance required at the time when the feed amount is set at a minimum value in a normal sewing operation. On the other hand, the sensor n2, which is farther of the two from the needle, is disposed at a distance L2 from the needle which is sufficient to ensure, after the output of a cloth terminus detection signal from the sensor n2, at least a stop enable distance required at the time when the feed amount is set at a maximum value in a normal sewing operation.

Figure 3:
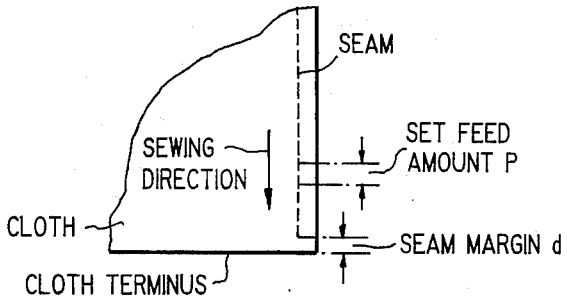
Figure 4:
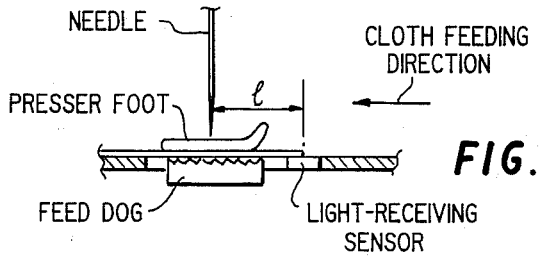
Figure 7:
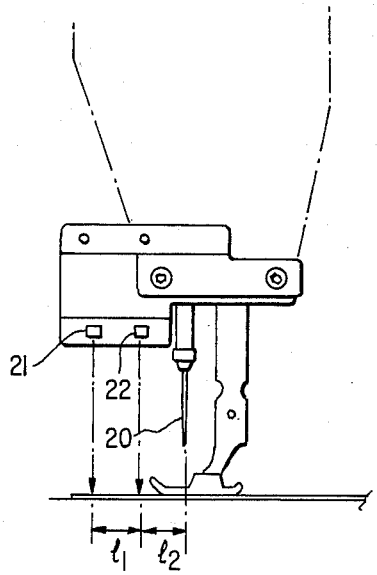
FIG. 7 PRIOR ART
FIG. 7 is a view used to explain a sewing operation performed with the prior art.

FIG. 3 shows the outline of a feed amount regulating mechanism of the apparatus of the present invention. A feed amount regulating member 3 having a cam portion 3*a* is secured onto a rotary shaft 4. A first feed amount detecting link 5 is mounted on the shaft 4. The arrangement reference position of the link 5 relative to the machine frame can be suitably determined. A bracket 6 is fixed to the machine frame, and the outer frame of a potentiometer 7 is fixed to the bracket 6.

A second feed amount detecting link 8, whose arrangement reference position relative to the machine frame can also be suitably determined, is fixed to the potentiometer 7. The first and second feed amount detecting links 5 and 8 are linked by a rod member 9. Reference numeral 10 denotes a feed amount regulating dial, and 11, a shaft for the dial 10. The feed amount regulating shaft 11 faces the cam portion 3*a* of the feed amount regulating member 3, and, when the feed amount regulating dial 10 is rotated by a rotating operation, the shaft 11 advances forward or retracts backward, so that a feed amount can be freely set at a desired value.

The amount through which the cam member 3 is rotated (and hence the thus determined feed amount) is transmitted to the potentiometer 7 and the value of the rotation amount of the cam member 3, i.e., the feed amount determined, is detected electrically.

FIG. 3 shows an example of a sewing operation.

This example is a case where the sewing is to be terminated at a location which is a seam margin d inward from the terminus of the cloth. Actually, in order to ensure the seam margin d, it is necessary to change the set feed amount P somewhere in the path. However, to simplify the explanation and facilitate readers' understanding, it is assumed that a distance l (in FIG. 4) from the needle to the cloth terminus being detected by the light receiving portion of one of the sensors is a multiple of the set feed amount P shown in FIG. 4.

Figure 5:
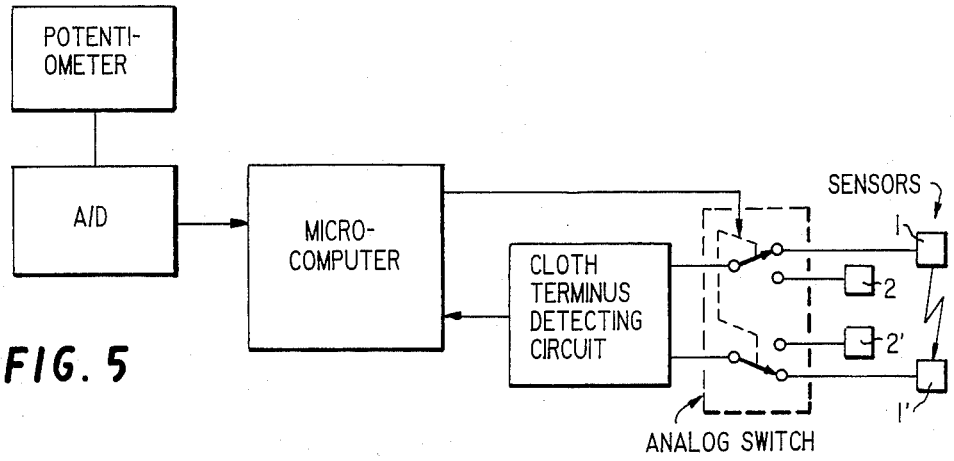
Figure 6:
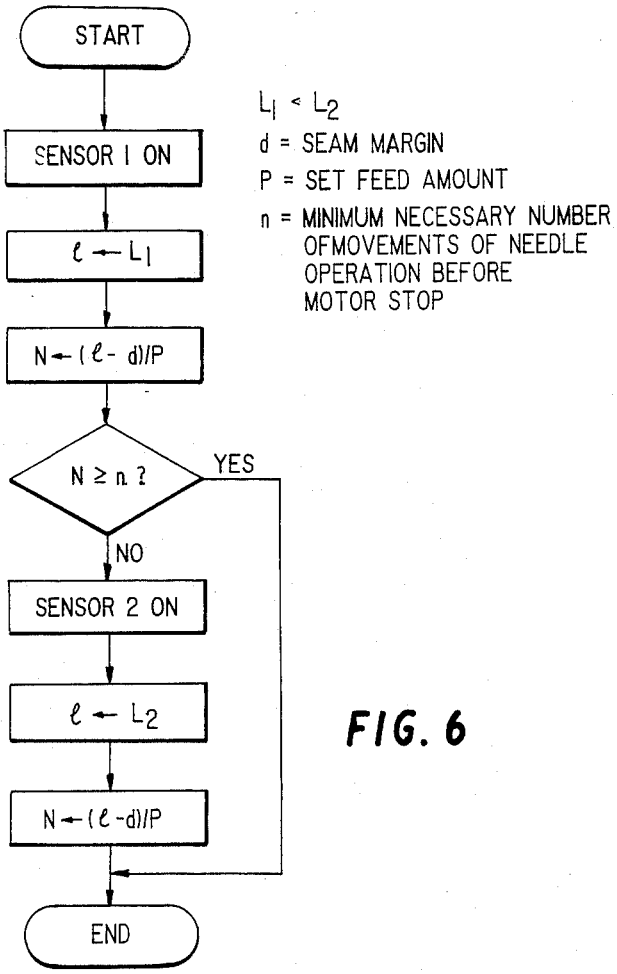

The operation of determining which of the sensors is to be used is described below with reference to the block diagram shown in FIG. 5 and the flowchart shown in FIG. 6. In performing calculations for this determination, the following values must be known: the seam margin d, the set feed amount P, and the minimum necessary number n of movements of the needle operation required before the machine stops (a number corresponding to the number n was described before relating to the stop enable distance).

Concerning the seam margin d, the value thereof is input by the operator through an input operation section, not shown.

Figure 2:
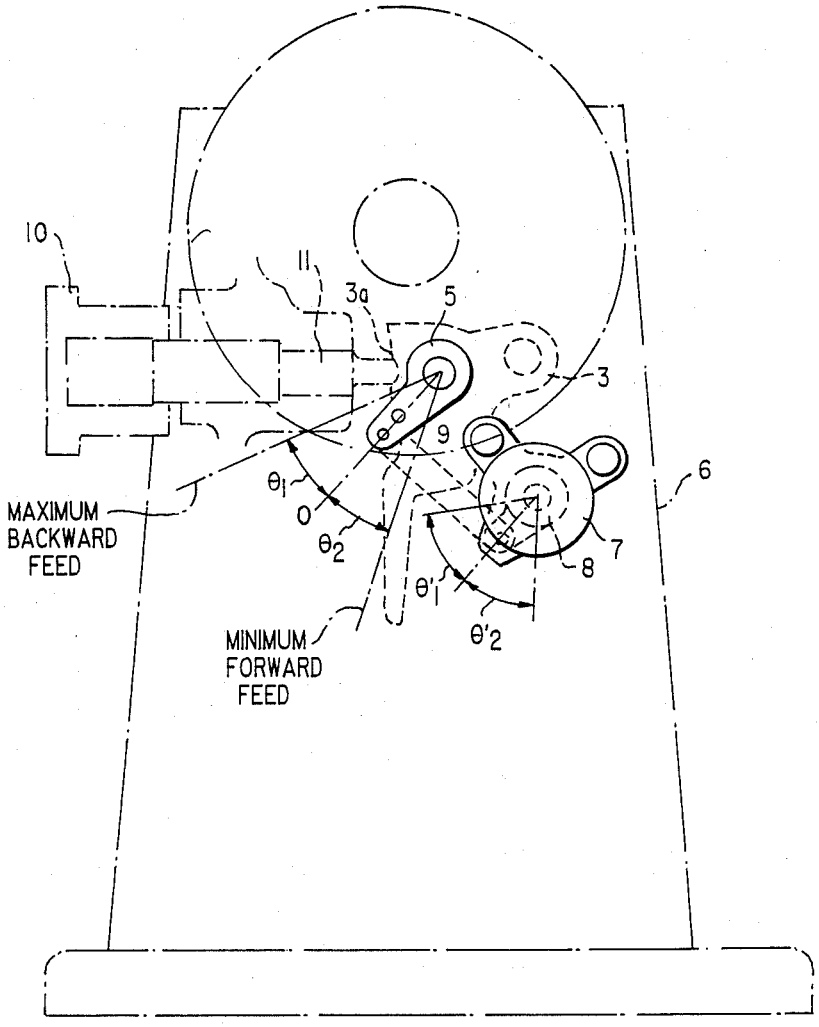
FIG. 2 is a view used to explain a feed amount regulating mechanism of the apparatus.

The set feed amount P is detected by the potentiometer 7 provided in the feed amount regulating mechanism shown in FIG. 2. After the detection, the output of the potentiometer 7 is supplied to the circuit shown in FIG. 5. That is, the change in voltage from the potentiometer 7 is subjected to A/D conversion and is then fed to a microcomputer to calculate the feed amount P. The microcomputer then operates in accordance with the program shown in FIG. 6 to determine which of the sensors is to be used. In accordance with the result of this determination, one of the static sensors is selected through the operation of an analog switch, as shown in FIG. 5.

Although it would be possible to use only one detection means and suitably adjust the distance between the needle and the sensor in accordance with the set feed amount, this may create a burden on the operator and may result in erroneous detection due to erroneous adjustment.

The present invention is capable of positively eliminating the disadvantages of the prior art and is also capable of avoiding the above-described drawback by virtue of the electrical and automatic selection among the sensors.

We claim:

1. An apparatus for detecting the terminus of cloth being sewn by a sewing machine comprising:

a plurality of sensors each consisting of a light emitting portion and a light receiving portion, said portions being paired and disposed in opposition, said sensors being disposed on a path along which said cloth is fed and at positions upstream of the needle of said machine;

means for electrically detecting a set cloth feed amount; and a selection circuit for electrically selecting one of said sensors consisting of paired light emitting and light receiving portions which is positioned at the optimum position with respect to said set cloth feed amount.

2. An apparatus according to claim 1, wherein said means for electrically detecting said set cloth feed amount is a potentiometer.

* * * * *